United States Patent [19]

Stein et al.

[11] Patent Number: 4,871,272

[45] Date of Patent: Oct. 3, 1989

[54] METHOD AND DEVICE FOR RESTARTING TYPEWRITERS AND PRINTERS WITH STEPPING MOTOR

[75] Inventors: Hans P. Stein; Armin Weise; Reinhold Will, all of Nuremberg, Fed. Rep. of Germany

[73] Assignee: TA Triumph-Adler Aktiengesellschaft, Nuremberg, Fed. Rep. of Germany

[21] Appl. No.: 78,147

[22] Filed: Jul. 27, 1987

[30] Foreign Application Priority Data

Jul. 26, 1986 [DE] Fed. Rep. of Germany ..... 3625387

[51] Int. Cl.[4] ..... B41J 11/42

[52] U.S. Cl. ..... 400/583; 400/54/63/70/902; 318/567

[58] Field of Search ..... 400/54, 61, 62, 63, 400/70, 76, 582, 583, 902; 318/567, 569

[56] References Cited

U.S. PATENT DOCUMENTS

| | | | |
|---|---|---|---|
| 4,085,837 | 4/1978 | Takano et al. | 400/583 |
| 4,279,523 | 7/1981 | Ringle | 400/54 X |
| 4,497,589 | 2/1985 | Figini | 400/61 X |
| 4,550,375 | 10/1985 | Sato et al. | 318/569 X |

FOREIGN PATENT DOCUMENTS

| | | | |
|---|---|---|---|
| 0170166 | 2/1986 | European Pat. Off. | 400/902 |
| 0202129 | 11/1986 | European Pat. Off. . | |
| 3518415 | 11/1985 | Fed. Rep. of Germany . | |
| 0147707 | 11/1980 | Japan | 318/567 |
| 0005114 | 1/1982 | Japan | 318/567 |
| 0071185 | 4/1983 | Japan | 400/54 |
| 0188480 | 10/1984 | Japan | 400/54 |
| 2045482 | 10/1980 | United Kingdom | 318/569 |

OTHER PUBLICATIONS

IBM Technical Disclosure Bulletin, "Theft Protection for Typewriters", Compton, vol. 25, No. 4, Sep. 1982, pp. 1975–1977.

IBM Technical Disclosure Bulletin, "Memory Protect Circuit During Power Interruption", Ehrsam, vol. 26, No. 4, Sep. 1983, pp. 2046–2047.

IBM Technical Disclosure Bulletin, "Battery Backup Failure Detection", Desautels et al., vol. 26, No. 6, Nov. 1983, pp. 2811–2812.

*Primary Examiner*—Ernest T. Wright, Jr.

*Attorney, Agent, or Firm*—Browdy and Neimark

[57] ABSTRACT

In a method for the operation of a typewriter, printer or the like with a stepping motor for the paper feed and a basic step inputting device, to accomplish feeding of the paper by a fraction of a line spacing, the feeding position set at the time of cutting off the machine is preserved by (1) storing the energization pattern last applied or information descriptive thereof in a value-preserving RAM at a first address, (2) storing a bit pattern contained in the control program in identical form at a second address of the value-preserving RAM, and (3) comparing the bit pattern of the control program which was stored in the second address of the RAM, when restarting the machine, with the bit pattern in the control program. The control program is stored preferably in a ROM of the central control unit, to verify as above the validity of the energization pattern stored in the RAM under the first address.

12 Claims, 2 Drawing Sheets

METHOD AND DEVICE FOR RESTARTING TYPEWRITERS AND PRINTERS WITH STEPPING MOTOR

BACKGROUND OF THE INVENTION

The invention relates to a method for the operation of typewriters, printers or comparable office machines, comprising a control unit including at least one microprocessor, a memory containing the control program, in particular a ROM, and a RAM for storing variable data with at least a part of the storage area being of the value-preserving type, a stepping motor to which the control unit can apply appropriate energizing pattern sequences to change the vertical position of the paper, and a basic-step inputting device which acts upon the stepping motor via the control unit so that, by its actuation, the stepping motor moves the paper by a fraction of a line spacing by executing at least one motor step.

The basic-step inputting device in such office machines serves the purpose of moving the line pattern, which is set choosing one of a plurality of interline spaces, relative to the paper by fractions of a line spacing, in order to be able to type at a precisely given position, e.g., when filling out a form or when setting up a table, a resolution of 16 basic steps typically being possible between two lines of normal typing. When subsequently depressing the normal line-spacing key, the shifted condition remains intact.

In conventional office machines of this type, after an interruption in the typing of a form, a preset energizing pattern is applied to the stepping motor upon restarting the machine, whereby the fine adjustment, made by means of a basic-step key device, for the form just being worked on is lost because, in the majority of cases, the preset energization pattern is not the same as the energization pattern applied to the stepping motor after the actuation of the basic-step key after each complete line spacing. Thus, the completion of a form could not be continued in such a manner that the spaces meant to be filled were actually occupied.

SUMMARY OF THE INVENTION

It is an object of the invention to develop a method for the operation of such an office machine so that there is assurance that, should even protracted operating interruptions occur, when the machine is restarted, the paper position last set remains the same also for the continuation of the work. In particular, the present invention makes it possible, when processing endless forms, to be able to resume their processing without problems, even after a protracted interruption. In addition, a defined initial state is to be established upon restarting the machine after trouble with the RAM content.

According to the invention, this problem is solved in that, for the exact preservation of the vertical position of the paper, the control unit stores an information describing the energization pattern last applied to the stepping motor under at least one first RAM address located in a value-preserving storage area, this first RAM address having been preset in the control program. The control unit further stores a bit pattern contained in the control program under at least one second address in the value-preserving RAM storage area. The bit pattern stored in the at least one second RAM address is compared with the bit pattern contained in the control program after the machine has been restarted.

In the event of coincidence, the first step of the sequence then applied starts from the energization pattern described by the information stored under the first RAM address, and the sequence is executed by energizing the stepping motor accordingly. In the event of non-coincidence, an energization pattern is applied to the stepping motor which is described by the information contained in the control program, and the first step of the sequence then applied starts from the energization pattern described by the information stored in the control program, and the sequence is executed by energizing the stepping motor accordingly.

In other words, the invention involves storing information describing the energization pattern last applied to the stepping motor at a first address in a value-preserving part of the RAM, and storing a bit pattern contained in identical form in the control program at a second address of the RAM. By comparing this bit pattern in the control program with the bit pattern stored in the second RAM address, it is made certain that the information stored at the first address in the RAM storage area, which information describes the last energization pattern, was not destroyed or disturbed by influences that occurred during the work interruption. This way it is ascertained whether, for instance as a result of static charging, voltage drops of the buffer batteries of the RAM or the like, the energization pattern stored at the first RAM address does not conform to the one actually last applied.

The present invention is advantageously realized so that, after starting the machine, and after the bit pattern contained in the control program has been compared with the bit pattern stored at the second RAM address, the control unit, in the event of coincidence, energizes the stepping motor upon the execution of the first step sequence starting from the energization pattern described by the information stored under the first RAM address, and updates the information stored under the first RAM address upon each application of an energization pattern to the stepping motor. In the event of non-coincidence, the control unit stores at the first RAM address an information preset in the control program and which describes an energization pattern preset in the control program, drives the stepping motor with this preset energization pattern at least once, energizes the stepping motor upon the execution of the first step sequence starting from the energization pattern described by the information stored under the first RAM address, and updates the information stored under the first RAM address upon each application of an energization pattern to the stepping motor.

In an advantageous method of storing the preset bit pattern for the control function in the event of non-coincidence as described above, after the machine has been turned on after the interruption and the bit pattern contained in the control program has been compared with the bit pattern stored under the second RAM address, the control unit again stores the preset bit pattern at the second RAM address. This thus provides for storing the correct bit pattern from the control program in the second address following non-coincidence in the preceding comparison.

According to another beneficial solution, the control unit stores the bit pattern contained in the control program in a rescue routine at the second RAM address, after stopping the machine.

A particularly critical operating state can originate when a machine of the kind in question is shut off while the stepping motor is executing a step sequence. In that case, no acknowledgment of the status reached at the time of the shut-off takes place, because the status depends on the mechanical contingencies so that the energization pattern last stored under the first RAM address does not conform to the last actual status in most cases. To remedy this situation, the control unit stores at the start of the execution of a step sequence a second bit pattern contained in the control program at the second RAM address, and re-establishes the bit pattern originally stored at the second RAM address after the execution of the step sequence. In the simplest case, by simply overwriting the bit pattern stored under the second RAM address during the time span a step sequence is being performed, it is made certain that a negative result is obtained when comparing, as provided by the invention, this bit pattern with a bit pattern stored in the ROM of the control program. Thus, an undefined initial status is prevented after the restart.

Other features, advantages and details of the invention follow from the description below of a preferred embodiment, with reference to the drawing.

DESCRIPTION OF PREFERRED EMBODIMENTS

The basic idea of the invention can be realized in entirely different embodiments in practical application. One particularly simple example is as follows.

Figure 2:
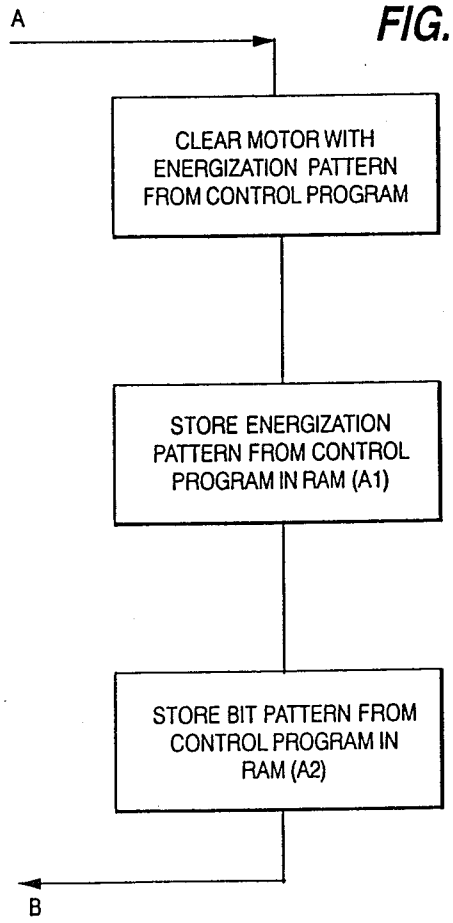
FIG. 2 shows a schematic flow diagram to illustrate the operating method according to the invention and the side branch-off points A and B in FIG. 1.
Figure 1:
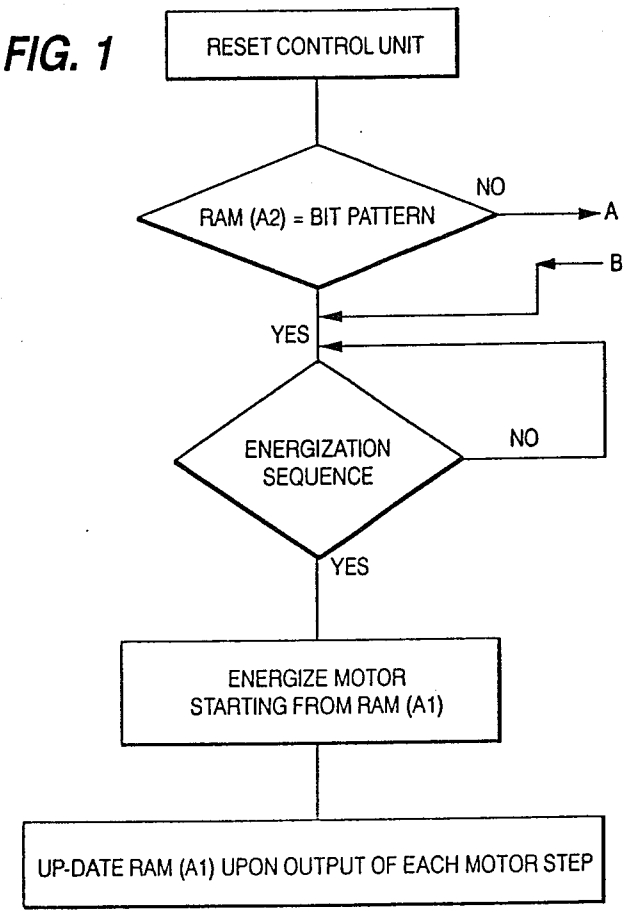
FIG. 1 shows a schematic flow diagram to illustrate the operating method according to the invention.
Figure 3:
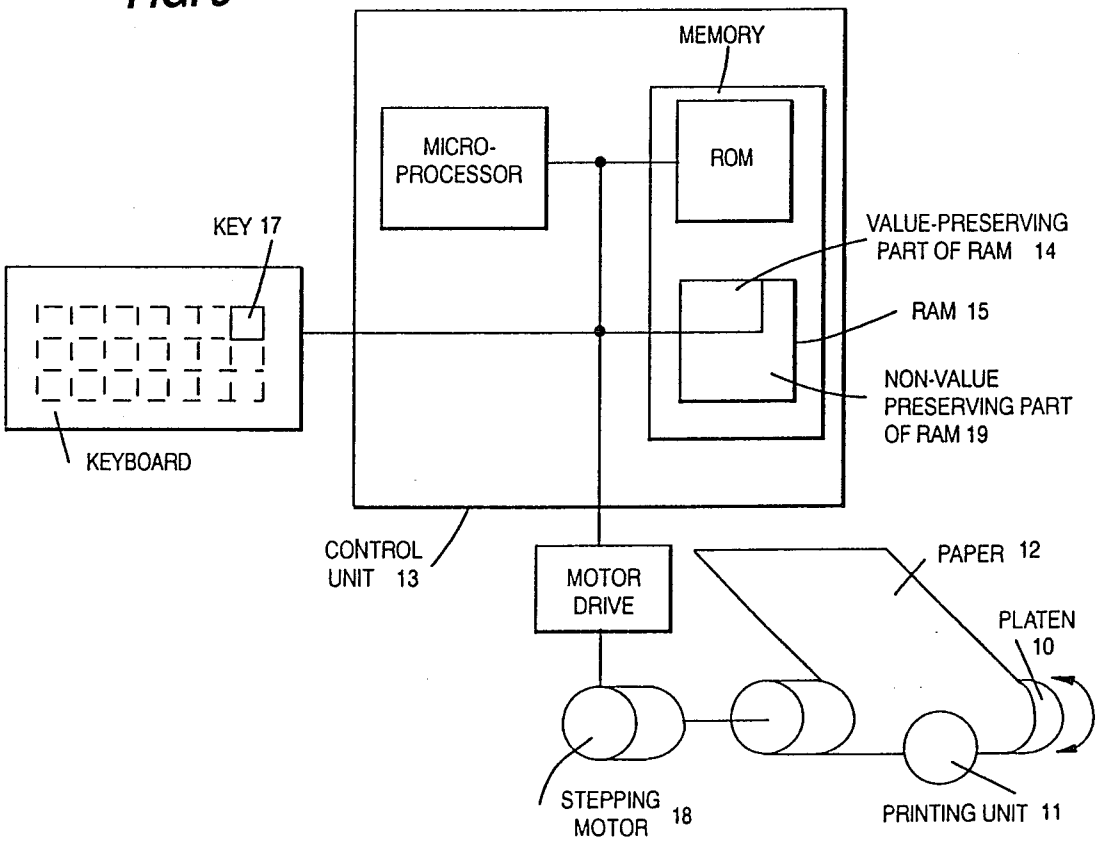
FIG. 3 indicates a printing apparatus with a stepping motor controlled by a control unit having a ROM and a RAM with a value-preserving part.

As shown in connection with FIGS. 1 and 2, after starting for instance an electric typewriter (having a platen 10 and printing unit 11 as shown in FIG. 3); after an interruption in the typing of a form 12, the control unit 13 is reset in a first step by the microprocessor MPC. Then the bit pattern stored in the value-preserving part 14 of the RAM 15 (of a memory means MEM) at the address A2 is compared with a bit pattern contained in the control program (stored in the ROM 16). If coincidence is found it may be assumed that the RAM's storage capabilities have not been adversely affected during the OFF state by a line voltage failure, static charges, or the like.

If non-coincidence of the bit patterns is found, indicating an impairment of the energization pattern stored in the RAM 13 at the first address, the procedure continues according to branch A (see FIG. 2).

If coincidence is found, indicating the correctness of the data stored in the value-preserving part 14 of the RAM 15, there follows as a third step the interrogation as to whether an energization sequence is to be performed by a motor driver MD, i.e. whether an operating key 17 of a keyboard KB triggering a feed operation of a form paper was actuated. In the negative, the question is repeated in a loop. In the affirmative, the stepping motor 18 for performing the paper feed is energized, starting with the energization pattern stored at the first RAM address A1.

With the output of each motor step, the energization pattern stored in the RAM 15 under the first address A1 is updated so that, upon a subsequent shut-off, the respective energization pattern last applied is stored.

In case of a disturbance of the energization pattern stored in the RAM 15 at the second address A2 during the shut-off phase, the procedure shown in FIG. 2 is followed. According thereto, if non-coincidence is found between the bit pattern stored in the RAM 15 at the second address A2 and the bit pattern contained in the control program (ROM)16, the motor 18 is cleared with an energization pattern from the control program. Then this energization pattern from the control program is stored in the RAM 15 at the address A1. Also, the first bit pattern for the validity check from the control program is stored in the RAM 15 at the second address A2, whereupon the procedure is continued according to the confluence B in FIG. 1 and as described above.

In expansion of the above-described example, a second bit pattern, likewise contained in the control program but differing significantly from the first bit pattern signaling the validity of the RAM information, can be stored in an additional step at the RAM address A2, immediately before each energization sequence is applied to the stepping motor 18. Directly after the end of the step sequence, the second bit pattern stored under the address A2 is then overwritten with the first bit pattern. If the machine is shut off during the execution of a step sequence, the RAM 15 will contain at the RAM address A2 a bit pattern which signals the invalidity of the RAM information. It goes without saying that the second bit pattern may also be stored at a third RAM address, for the comparison to verify that shut-off occurred during the energization sequence, but this must be checked out first upon restarting the machine.

Further, the information describing the energization pattern last applied to the stepping motor 18 can also be stored during the operation of the machine in the non-value preserving RAM part 19. This also applies to the first bit pattern for signaling the validity and to the second bit pattern for signaling the invalidity. In this variant of the method, the energization pattern information and the first or second bit pattern are then transferred to the value-preserving part 14 of the RAM 15, from the non-value preserving part 19 of the RAM 15, by means of a rescue routine after the machine is shut off.

It will be obvious to those skilled in the art that various changes may be made without departing from the scope of the invention. The invention is not to be considered limited to what is shown in the drawings and described in the specification, but only by the scope of the following claims.

What is claimed is:

1. A method for operating a machine for printing on a paper, such as a typewriter, printer or the like, said machine having a control unit comprising a microprocessor and a memory, said memory storing a control program for said microprocessor and including a RAM for storing variable data, said RAM being of the value-preserving type at least in part of its storage area, a stepping motor connected to the control unit and supplied with sequences of energization patterns under the control of said control unit, to move the paper, a basic step input device which causes, by each actuation thereof by an operator of the machine, the stepping motor to be supplied with a respective corresponding sequence of at least one of said energization patterns by the control unit, so that the stepping motor executes at least one predetermined step to move the paper by at least one corresponding, predetermined fraction of a normal line spacing for each said actuation, wherein any successive pair of said energization patterns of each said corresponding sequence are different from each other, said method comprising:

said control unit storing an information identifying the energization pattern lastapplied to the stepping motor at at least one first address located in said value-preserving part of said RAM;

said control unit storing a first bit pattern, contained in the control program, in identical form at at least one second address in the value preserving part of the RAM; and upon the restart of the machine after a shut-off of power thereto, said control unit comparing a bit pattern then in storage at the at least one second RAM address with said first bit pattern contained in the control program;

wherein, (1) in the event of coincidence from the comparing, the stepping motor is enegized so that the first energization pattern sequence applied after said restart starts from said energization pattern identified by said information stored at said first RAM address, and (2) in the event of non-coincidence, the stepping motor is energized after said restart at least once with a predetermined one of said energization patterns identified by a further information contained in the control program, and the first energization pattern sequence thereafter applied starts from said predetermined energization pattern identified by said further information contained in the control program.

2. A method according to claim 1, wherein, after the machine is turned on for said restart, and after said comparing of said first bit pattern contained in the control program with the bit pattern stored at the second RAM address, in the event of said coincidence, and after said energizing of the stepping motor by the control unit upon the execution of the first step sequence starting from the energization pattern identified by the information stored at said first RAM address, the control unit updates the information stored at said first RAM address upon each application of an energization pattern of the sequence to the stepping motor, each said information stored at said first RAM address then identifying the respective energization pattern last-applied to said stepping motor, in the event of said non-coincidence, said control unit stores at said first RAM address respective information identifying said predetermined energization pattern identified by said further information contained in the control program, the control unit drives the stepping motor with said predetermined energization pattern at least once, subsequently energizes the stepping motor with the next energization pattern sequence to be then applied, which next sequence starts from said predetermined energization pattern identified by the information stored under the first RAM address, and respectively updates the information stored at said first RAM address upon each application of an energization pattern to the stepping motor.

3. A method according to claim 1, wherein after said restart of the machine and after said first bit pattern contained in the control program has been compared with the bit pattern stored at said second RAM address, in said event of non-coincidence, said control unit stores said first bit pattern contained in the control program at said second RAM address.

4. A method according to claim 1, wherein said control unit, after said shut-off, stores said first bit pattern contained in the control program in a rescue routine at said second RAM address.

5. A method according to claim 1, wherein the control unit stores in the RAM a respective information characterizing the current ON-OFF switching status of said stepping motor, this information being interrogated by said control unit after said restart, whereby it is determined whether said shut-off occurred during a stepping operation of said stepping motor.

6. The method of claim 1, wherein the control unit stores in the RAM a respective information characterizing the current ON-OFF switching status of said stepping motor, this information being interrogated by said control unit after said restart, whereby it is determined whether said shut-off occurred during a stepping operation of said stepping motor, said information characterizing the current ON-OFF switching status of the stepping motor at the beginning of performing each said energization pattern sequence being a second bit pattern from said control program that is stored in at least one address of said RAM, and being over-written by said control unit with said first bit pattern from said control program at the completion of each respective energization pattern sequence.

7. A method of claim 6, wherein said at least one RAM address is said second RAM address, and the bit pattern stored in said second RAM address is compared after said restart with said second bit pattern in said control program, for said determining that said shut-off occurred during execution of an energization pattern sequence.

8. The method of claim 6, wherein said second bit pattern is written, prior to performing each said energization pattern sequence, into a third address of said RAM, and the content of said third address of said RAM is checked with said second bit pattern from said control program after said restart, for said determining of whether said shut-off occurred while an energization pattern sequence was being performed.

9. The method of claim 6, wherein said at least one address at which said informatio characterizing said ON-OFF status of the stepping motor is stored being said second address of the RAM, and said first bit bit pattern characterizing said OFF status of the stepping motor.

10. The method of claim 6, wherein said at least one address at which said information characterizing said ON-OFF status of the stepping motor is stored being a third address of the RAM.

11. An apparatus for operating a machine for printing on a paper, such as a typewriter, printer or the like, said apparatus comprising a control unit comprising a microprocessor and a memory, said memory storing a control program for said microprocessor and including a RAM for storing variable data, said RAM being of the value-preserving type at least in part of its storage area, a stepping motor connected to the control unit and supplied with sequences of a plurality of different energization patterns under the control of said control unit, to move the paper, and a basic step input device which causes, by each actuation thereof by an operator of the control unit, the stepping motor to be supplied with a sequence of at least one energization pattern by the control unit, so that the stepping motor executes at least one step to move the paper by at least one corresponding, predetermined fraction of a normal line spacing for each said actuation, wherein:

for preserving an exact vertical position of the paper after shut-off and restart of the machine, an information identifying the energization pattern last-applied to the stepping motor is stored by the control unit at a first address located in said value-preserving part of said RAM;

a first bit pattern, contained in the control program, is stored in a second address in the value preserving part of the RAM;

upon the restart of the machine, the control unit compares a bit pattern then in the second RAM address with said first bit pattern in the control program;

(1) in the event of coincidence from the comparing, the stepping motor is energized so that the first energization pattern sequence then applied starts from said energization pattern identified by said information stored at said first RAM address, and (2) in the event of non-coincidence, the stepping motor is energized with a predetermined one of said energization patterns identified by a further information contained in the control program, and the first energization pattern sequence then to be applied starts from said predetermined energization pattern identified by said further information contained in the control program; and data corresponding to an initial selection by an operator of a fraction of said normal line spacing, prior to said shut-off, for printing a plurality of lines separated by respective integral numbers of said normal line spacing, is stored and checked on after said restart, so that said typing by said operator after said restart continues with respect to said initial selection of said fraction of a normal line spacing, irrespective of said shut-off, in said event of coincidence of said bit pattern stored in said second address of said memory after said restart and said first bit pattern in said control program.

12. The apparatus of claim 11, wherein a second bit pattern contained in said control program is stored at said second address of said value-preserving part of said RAM at the beginning of performing each said energization pattern sequence, and overwritten with said first bit pattern from said control program when each said energization pattern is completed, so that a check on the stored value in said second address after said restart allow determining whether the energization pattern sequence last being performed was completed prior to said shut-off.

* * * * *